US006886187B2

(12) United States Patent
Zell et al.

(10) Patent No.: US 6,886,187 B2
(45) Date of Patent: May 3, 2005

(54) SWIMMING POOL SAFETY COVERS

(75) Inventors: James Zell, Washington Crossing, PA (US); Andrew Maggion, Skillman, NJ (US)

(73) Assignee: Merlin Industries, Inc., Hamilton, NJ (US)

( * ) Notice: Subject to any disclaimer, the term of this patent is extended or adjusted under 35 U.S.C. 154(b) by 0 days.

(21) Appl. No.: 10/387,900

(22) Filed: Mar. 13, 2003

(65) Prior Publication Data

US 2004/0177435 A1 Sep. 16, 2004

(51) Int. Cl.[7] ..... E04H 4/00
(52) U.S. Cl. ..... 4/498
(58) Field of Search ..... 44/502, 504; 4/498

(56) References Cited

U.S. PATENT DOCUMENTS 2,958,872 A * 11/1960 Meyer, Jr. ..... 4/503
3,593,757 A * 7/1971 Haynes ..... 139/383 R
5,887,296 A * 3/1999 Handwerker ..... 4/498
6,286,156 B1 * 9/2001 Sullivan ..... 4/498

* cited by examiner

*Primary Examiner*—Charles E. Phillips
(74) *Attorney, Agent, or Firm*—Henry I Schanzer

(57) ABSTRACT

Pool covers embodying the invention are formed of a very dense mesh material which ensures substantially one hundred percent shade while allowing water to pass uniformly through the cover and which is adequately strong to support the weight of an adult. The pool cover is formed of plastic fibers which are interwoven to form a dense mesh which is then subjected to a pressure and heat cycle to ensure that the resultant material has the requisite properties for allowing water to pass through at a desired rate (e.g., 0.1 to 5 gallons per square foot per minute) while blocking light (e.g., 100% shade). Thus, a self-filtering safety pool cover is formed which allows for water to pass through uniformly across its surface while blocking sunlight.

7 Claims, 4 Drawing Sheets

38 THREADS / INCH

13 THREADS / INCH

SWIMMING POOL SAFETY COVERS

BACKGROUND OF THE INVENTION

This invention relates to "safety" covers for swimming pools for keeping debris from entering the pool water and preventing water puddles on the upper surface of the pool cover.

Pool covers are known and examples are disclosed, for example, in U.S. Pat. No. 3,184,764 (West) U.S. Pat. No. 4,233,695 (Rowney) and U.S. Pat. No. 5,259,078 (Crandall), the subject matter of which are incorporated herein by reference. A principal purpose of such pool covers is to prevent entry of debris into the pool during periods of non-use, e.g. during extended periods of time from the end of one swimming season to the beginning of the next.

A principal purpose of a "safety" pool cover is to prevent harm to persons, particularly small children and animals venturing onto the pool cover. One particular hazard is the formation of puddles on the upper surface of the pool cover, such puddles creating drowning hazards. This problem is particularly avoided by the present invention Some pool covers are made to be water impervious, for preventing dirty water and debris from entering the underlying pool, and are tautly suspended over the surface of the pool. Inevitably, the cover sags between its points of suspension thereby forming one or more dependent pockets which tend to deepen as rain water and debris collect on the cover. A known solution for preventing the accumulation of water in the pool cover pockets is to provide drain openings through the pool cover at the bottoms of the pockets for draining the otherwise accumulating water directly into the underlying pool. The drain openings are covered by debris collecting filters whereby only relatively clean, filtered water enters the pool.

The filtered drain openings may be included in the pool covers during manufacture and are located on the covers at the anticipated lowermost cover portions when the covers are mounted on the pools. A somewhat unexpected problem is that identical pool covers mounted on identical pools will often assume different drape configurations including differently located pockets of maximum sag. One cause for this, for example, is the use of different tensions in the means, straps, springs and the like, used for mounting the pool covers on the different pools. To the extent that the existing drain openings are spaced from the actual points of maximum sag of the pool covers, pools of water collect on the covers. This is avoided in accordance with this invention.

Another principal purpose of a "safety" pool cover is that it be adequately strong to fully support the weight of a human adult walking across the surface of the pool mounted cover. A problem with known pool covers of the type containing drain openings is that the presence of the openings through an otherwise continuous pool cover provides regions of reduced strength where tearing and rupture of the pool cover can occur. This problem is avoided by pool covers embodying the invention.

Another problem with known pool covers is that the drain openings allow sunlight to pass through the covers. The sunlight provides sufficient energy to allow the growth of algae and like plants or fungi within the water in the pool.

SUMMARY OF THE INVENTION

Accordingly, pool covers embodying the invention are formed of a material which provides a very dense mesh which ensures substantially one hundred percent shade while allowing water to pass (or seep) through the cover into the underlying pool, evenly over the entire pool cover surface, and which is adequately strong to support the weight of an adult.

In one embodiment of the invention the pool cover is formed of plastic fibers (yarns and/or threads) which are interwoven or interlaced to form a dense mesh. The dense mesh (or basic material) is then subjected to a pressure and heat cycle to ensure that the resultant material has the requisite properties for allowing water to pass through at a desired rate while blocking light. By way of example, the basic material may be specially calendered; i.e., the woven material is passed and pressed between rollers (cylinders) of a calendering machine so the material is given a smooth and even finish by the pressure exerted by the roller of the calendering machine. By controlling the density of the mesh of the pool cover material (e.g., the size of the fibers extending in the vertical and horizontal direction and the number of fibers per unit area) and the pressure and heat applied to the basic material, the resultant material develops the requisite properties when it is "calendered" i.e., a self-filtering pool cover is formed which allows for water to pass through uniformly and evenly across its surface while blocking sunlight. The pool cover may be also characterized as a safety-cover when the fibers are selected to have sufficient strength to support the weight of an adult.

DESCRIPTION OF THE DRAWING

FIG. 5 is a cross sectional diagram of a section of a pool cover embodying the invention showing sunlight being blocked from passing through.

DESCRIPTION OF PREFERRED EMBODIMENTS

Figure 1:
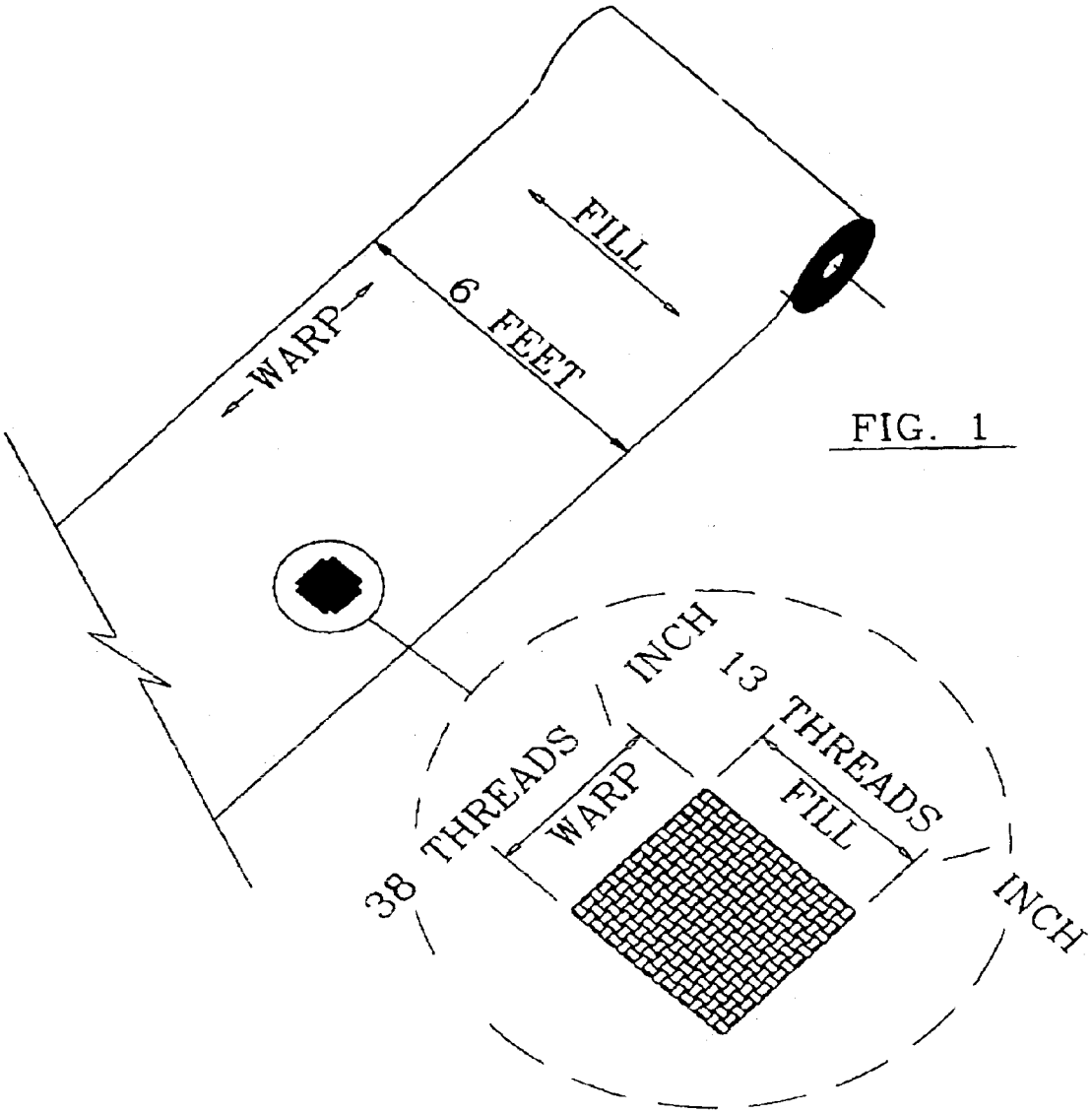
FIG. 1 is a plan view of a spool on which is rolled a plastic material embodying the invention to form a pool cover formed of a material embodying the invention.

The present invention pertains to pool covers made wholly, or partially, of a "mesh" material or fabric. An advantage of mesh covers is that they prevent the accumulation of rain and melting snow by allowing water to pass through the cover material. Allowing water to pass through the mesh cover eliminates the need for a pump or a drain on or in the cover. Another advantage of mesh covers is that they are lighter in weight than solid covers. Due to their lighter weight, mesh covers can be stretched more tautly over a pool surface than solid covers. Still another advantage of mesh covers is that since they do not permit water to accumulate on the cover and since they tend to be and remain tightly stretched, debris that falls on the cover tends to get blown off rather than having to be manually removed. Mesh covers tend to be cleaner than other covers and to require less maintenance than solid covers over the course of time.

Prior art mesh covers suffer from some distinct disadvantages. The "weaves" of prior art mesh covers allows large amount of sand and silt to pass through the cover resulting in an adverse effect on the quality and clarity of the water in the pool covered by these mesh covers. As a result pools covered by prior art pool covers require substantial clean up when opened for the season. Another disadvantage of known mesh covers is that they provide poor shading to sunlight. Consequently, as noted above, algae, a microscopic plant-life commonly found in swimming pools tends to thrive during the early spring months in pools covered by mesh covers. Many homeowners who use a mesh cover also have to use a solid cover underneath the mesh cover to avoid this problem.

The disadvantages of the prior art mesh covers are overcome with mesh covers embodying the invention. A mesh cover embodying the invention provides 100% shading (according to the ASTM standard) and also provides sand and silt filtration due to a large increase in the size of the threads interwoven to form the mesh fabric. This is done while enabling water due to rain and/or melting snow to pass through the cover. The mesh material of the invention has properties very similar to materials used to make solid covers, but is lighter in weight. A mesh cover embodying the invention functions as a self-filtering cover (i.e., the filter is built within the fabric used to from the pool cover). The mesh cover allows water to pass through, eliminating the need for drains and a water pump to remove water from the cover.

An entire pool cover can be made of the mesh material or the mesh material may be used only in, and for, predetermined portions of a pool cover. Of significance is that a single mesh layer may be used to cover the pool, providing lightweight protection and ease of covering and uncovering the pool.

The fabric used to manufacture a pool cover embodying the invention may have the following range of characteristics. [Note that in the description below, where applicable, the terms are as defined by, and in accordance with, ASTM standards.]

1—Any material having the requisite strength and pliability exhibited for example by polypropylene or any like plastic material.

2—threads per inch—(a) 30–40 threads per inch along a first direction (e.g., the horizontal or warp) direction; and (b) 10–20 threads per inch along a second direction, generally perpendicular to the first direction, (e.g., the vertical or fill direction). In the discussion to follow and in the appended claims, the threads along the first direction may be also referred to as a first set of fibers having a first density lying in a first direction, and the threads along the second direction may be also referred to as a second set of fibers having a second density lying in a second direction.

3—yarn size and type—(a) the threads along one direction (e.g., the warp) range in size from 500–700 deniers; and (b) the threads along the other, generally perpendicular, direction (e.g., the fill) range in size from 2000–3500 deniers.

4—weight of material—may range from 7–10 ounces per sq. yd.

5—Grab tensile—may range (a) along the warp from 200–400 lbs and (b) along the fill from 400–600 lbs.

6—Burst 600–800 pounds per sq. in. (PSI).

7—Tear—may range: (a) along the warp from 50–150 lbs and (b) along the fill from 150–350 lbs.

8—Air flow which is a measure of the amount of water which can flow through the cover may range from 5 to 30 cubic feet per meter (cfm).

9—Shade—100% after the cover material is processed through a heat and pressure cycle (e.g., calendered).

The various numbers and characteristics given above are by way of example. Note that different sizes and weights and characteristics of the material may be used without departing from the teachings of the invention which is directed to high density mesh covers which allow water to pass through while blocking sunlight, (i.e., providing 100% shade according to ASTM standard).

In accordance with the invention, a selected weave may be subjected to greater or lesser pressure and cycle through different temperature ranges to provide the desired 100% shading while allowing water to pass through at a rate ranging from 0.1 to 5 gallons per square foot per minute.

FIG. 1 shows a spool on which is mounted a sheet of material embodying the invention, which material is used to form pool covers embodying the invention. By way of example, the sheet may have a width of 6 feet and a length of more than 200 yards. Pieces of material from one or more spools may be cut and the pieces of material are then stitched together to form a pool cover having a desired shape for appropriately covering a selected swimming pool.

Figure 2:
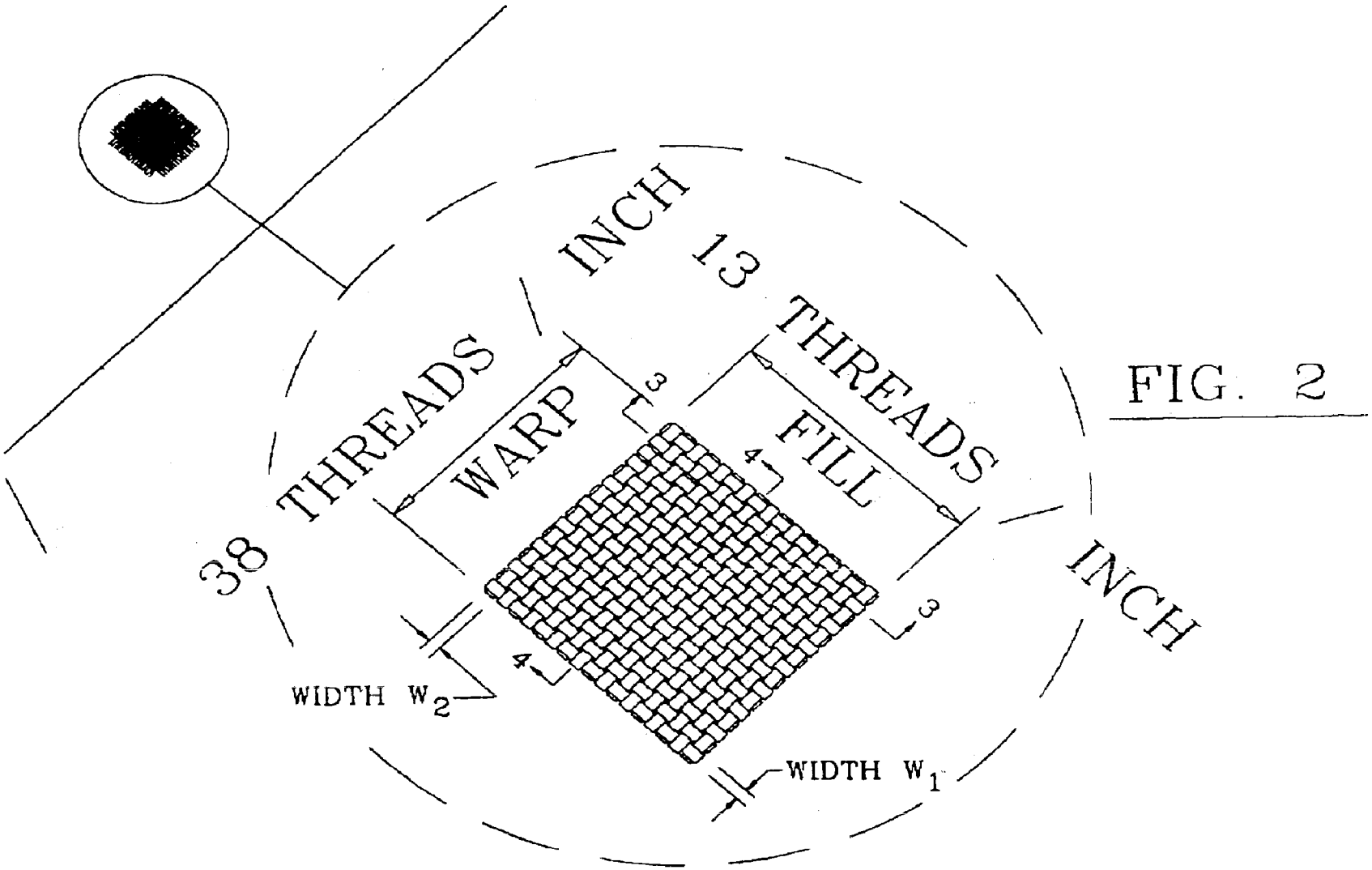
FIG. 2 is a top view of a swatch of the pool cover material.

FIG. 2 is a top view of the pool cover material showing that the cover is formed by interweaving (interlacing) threads (fibers or yarn) made of polypropylene plastic in directions which are generally perpendicular to each other. In a particular embodiment, material embodying the invention was made with a first set of fibers comprising 38 threads per inch along one direction (e.g., the horizontal direction) also referred to as the "warp" and with a second set of fibers comprising 13 threads per inch along the other, generally perpendicular direction (e.g., the vertical direction) also referred to as the "fill". The size (diameter) of each thread in the "fill" (or Y) direction was approximately 3000 denier (0.076 inches) and the size (diameter) of each thread in the "warp" (or X) direction was approximately 525 denier (0.026 inches).

Figure 4:
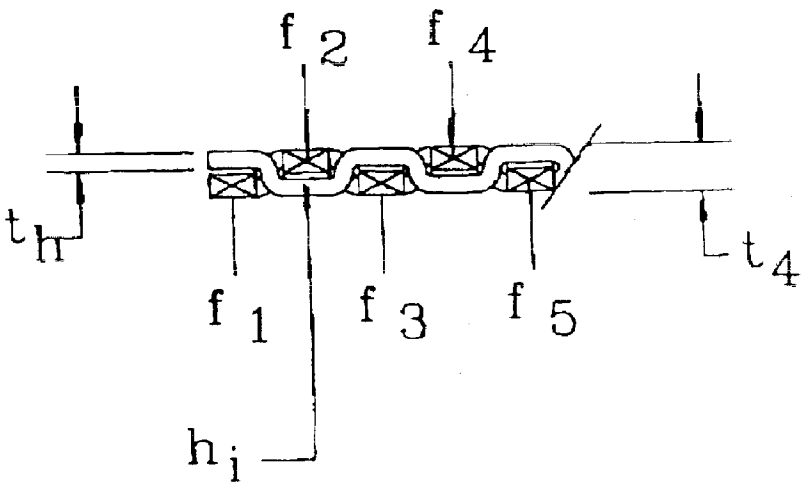
FIG. 4 is a cross sectional diagram of the pool cover shown in FIG. 1 taken along line 4—4 thereof.
Figure 3:
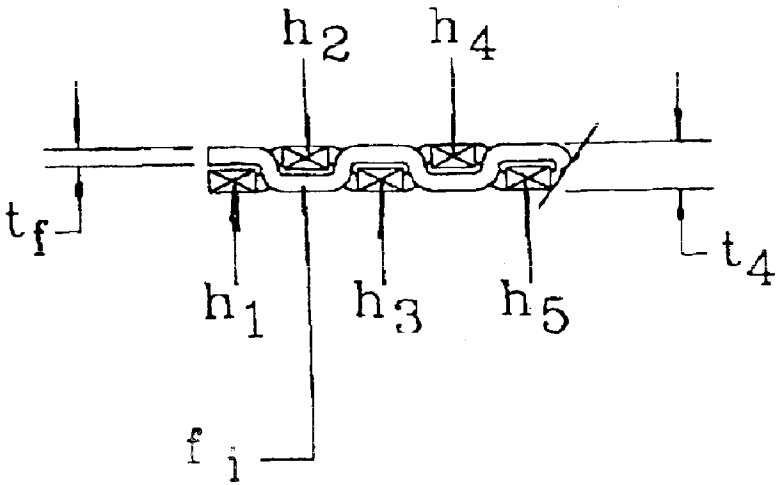
FIG. 3 is a cross sectional diagram of the pool cover shown in FIG. 1 taken along line 3—3 thereof.

The threads (fibers) are interwoven as shown in FIGS. 2, 3 and 4 to form a tight and strong weave. FIG. 3 is a cross-sectional diagram of the material taken along line 3—3 of FIG. 2. FIG. 3 shows one fiber (fi), running along the "fill" direction, weaving above selected horizontal fibers (e.g., h1, h3, h5) and then below alternate horizontal fibers (e.g., h2, h4). FIG. 4 is a cross-sectional diagram of the material taken along line 4—4 of FIG. 2. FIG. 4 shows one fiber (hi), running along the "warp" direction, weaving above selected horizontal fibers (e.g., f1, f3, f5) and then below alternate horizontal fibers (e.g., f2, f4). The thickness $t_f$ of the cover so formed, as shown in FIGS. 3 and 4, may range from less than 0.009 inches to more than one-half inch. Thinner and thicker pool covers may be formed so long as they have the desired strength and other characteristics, described above. Note that selecting fibers of a general dark colors (e.g., green, blue, black) aides in blocking light rays from passing through the cover.

After the threads are interwoven to form the basic interconnecting pattern, the resultant woven material is then subjected to a calendering process. That is, the basic material, as woven, is processed in a calendering machine (not shown) having cylindrical rollers between which the material is passed with the rollers compressing the basic woven material. By appropriate selection of the pressure and heat applied to the basic woven material when it is passed between the rollers during the calendering process, the amount of water that can pass (or seep) through the material per unit area and per unit time can be controlled. The process during which the basic material is subjected to pressure and heat (generally referred to herein as "calendering") is also used to control the amount of light that can pass through the cover. For covers embodying the invention the amount of shade provided by the processed material is 100% as per the ASTM standard.

Thus, in one embodiment of the invention, a pool cover includes a basic mesh plastic material formed of threads of polypropylene material with an appropriate selection of: (a) the number of threads per unit length in the fill direction and in the warp direction and (b) the size of the threads in the fill and warp direction. Also included is the processing of the basic material during which an appropriate selection of pressure and heat are applied to ensure that water can pass through the material used to make a pool cover to prevent the accumulation of water above the cover while blocking light from passing through the cover. It should be appreciated that if the weave is made too tight and/or if the calendering process in conjunction with the tight weave makes the processed material too tight, the resultant material will indeed block the light but the material will become partially or totally impervious to water. That is, water will accumulate above the cover. This problem is overcome in pool covers manufactured in accordance with the invention.

Figure 5:
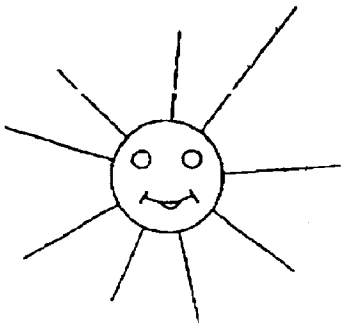
Figure 5:
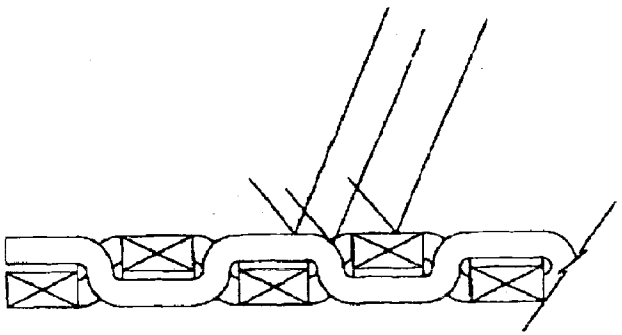

FIG. 5 illustrates that the formation of the weave after the application of requisite pressure and heat (e.g., calendaring) is such that light incident on the top surface of the swimming pool cover does not pass through, providing 100% shade according to the ASTM standard.

Figure 6:
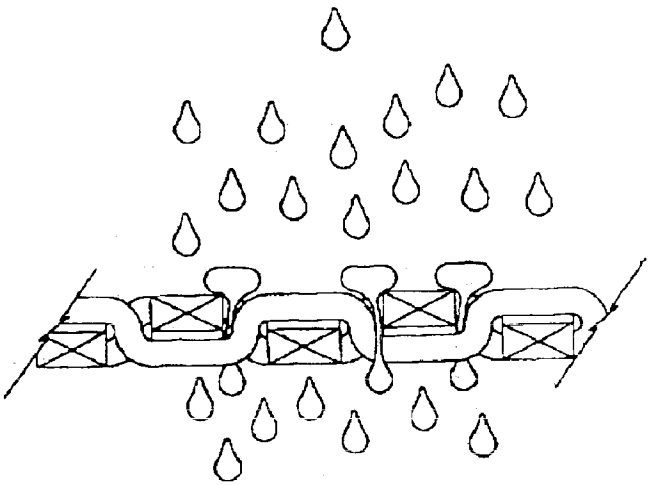
FIG. 6 is a cross sectional diagram of a section of a pool cover embodying the invention showing water passing through the pool cover.

FIG. 6 illustrates that for the light blocking material shown in FIG. 5, water deposited on top of the cover surface passes through the cover. Consequently, in accordance with the invention, water is allowed to pass through the cover while the amount of light which can pass through is limited and/or blocked.

A pool cover embodying the invention is intended to be draped over a pool and attached to peripheral portions of the pool structure. The pool cover is of the "safety" type, and to this end, it is stretched in a taut condition over the pool and spaced from the surface of the pool water. Any attaching arrangement (see U.S. Pat. No. 5,713,087) can be used, as well as other known or suitable attaching arrangements. For example, straps extending beyond the sheet edges may be used to provide means for rigidly securing the pool cover to securing means, e.g., pop-ups (pegs) mounted on the pool decking. Additionally, various springs can be used for maintaining tautness of the cover under varying temperature and loading conditions.

Depending upon the size of the pool cover, its shape, attaching, and strengthening arrangements, one or more sections of the pool cover may experience some temporary sag and may temporarily form pockets. This may be so during rain storms. However, in accordance with the invention, water does not accumulate above the pool cover. Rather, any water above the pool cover passes through the cover at a predetermined rate (e.g., 1 gallon per square foot per minute). This eliminates the need for drains which adds labor costs and introduces weaknesses in the cover.

In accordance with the invention, the cover portion shown in FIGS. 1–6 is self-draining for filtering the collected water and rapidly draining the collected water into the underlying pool. Of course, any debris will collect on top of the cover. This debris can be selectively removed or be blown away by the wind.

As mentioned, FIGS. 1–6 show a pool cover in accordance with this invention. A feature of the invention is that the cover is self-draining while blocking sunlight from passing through.

As noted above, cutting any opening through a pool cover to provide a draining function tends to weaken the cover. "Safety" pool covers are preferably strong enough to withstand the weight of an adult walking across the mounted and suspended pool cover. In many instances, to obtain the needed strength with known pool covers, extra reinforcing means must be provided in the pool cover adjacent to the drain openings to compensate for the loss of strength caused by the drain openings. This is generally not necessary using pool covers of the type herein described.

What is claimed is:

1. A pool cover comprising:

a sheet of plastic material formed of plastic fibers which are interwoven, with a first set of fibers lying in a first direction having a first density and a second set of fibers, lying in a second density, lying in a second direction, generally perpendicular to the first direction, said first and second set of fibers forming a high density mesh pattern enabling water to pass through the pool cover while blocking light from passing through the cover, at approximately 100% shade as defined in the ASTM standard whereby water can not accumulate on top of the pool cover and light is blocked to prevent the growth of algae in the water within the pool.

2. The pool cover as claimed in claim, 1 wherein the fibers are forming the pool cover are subjected to a pressure cycle and heat to modify the characteristics of the material to allow water to pass through the material while blocking light.

3. The pool cover as claimed in claim 1, wherein the material allows water to pass through the material at a rate ranging from 0.01 to 5 gallons per square foot per minute.

4. The pool cover as claimed in claim 1, wherein the pool cover can withstand the weight of an adult.

5. A pool cover as claimed in claim 2, wherein the first set of fibers corresponds to the fibers disposed in the fill direction and the second set of fibers corresponds to the fibers disposed in the warp direction; wherein in the number of fibers per inch in the fill direction is less than the number of fibers pr inch in the warp direction; and wherein the diameter and size of the fibers in the fill direction is greater than the diameter and size of the fibers in the warp direction.

6. A pool cover claimed in claim 5, wherein there are approximately 13 fibers per inch in the fill direction of approximately 3000 denier and there are approximately 38 fibers per inch in the warp direction of approximately 525 denier.

7. A pool cover as claimed in claim 5, wherein the fibers forming the pool cover are subjected to a heat and pressure cycle for enabling water to pass through the cover while blocking sunlight.

* * * * *